US010786915B2

(12) United States Patent
Zafiropoulos et al.

(10) Patent No.: US 10,786,915 B2
(45) Date of Patent: Sep. 29, 2020

(54) SHAVING BLADE CARTRIDGE AND A SHAVER COMPRISING SUCH SHAVING BLADE CARTRIDGE

(71) Applicant: BIC-VIOLEX S.A., Anixi (GR)

(72) Inventors: Panagiotis Zafiropoulos, Wallingford, CT (US); Panagiotis Moustakas, Petroupoli (GR)

(73) Assignee: BIC-VIOLEX SA, Anixi (GR)

( * ) Notice: Subject to any disclaimer, the term of this patent is extended or adjusted under 35 U.S.C. 154(b) by 9 days.

(21) Appl. No.: 15/537,502

(22) PCT Filed: Dec. 24, 2014

(86) PCT No.: PCT/EP2014/079295

§ 371 (c)(1),
(2) Date: Jun. 19, 2017

(87) PCT Pub. No.: WO2016/102024

PCT Pub. Date: Jun. 30, 2016

(65) Prior Publication Data

US 2017/0341247 A1 Nov. 30, 2017

(51) Int. Cl.
*B26B 21/40* (2006.01)
*B26B 21/22* (2006.01)
(Continued)

(52) U.S. Cl.
CPC ..... *B26B 21/4012* (2013.01); *B26B 21/222* (2013.01); *B26B 21/227* (2013.01);
(Continued)

(58) Field of Classification Search
CPC . B26B 21/4012; B26B 21/227; B26B 21/527; B26B 21/565
(Continued)

(56) References Cited

U.S. PATENT DOCUMENTS 8,146,255 B2 * 4/2012 Denkert ..... B26B 21/227 30/49
8,336,212 B2 * 12/2012 Bozikis ..... B26B 21/227 30/50
(Continued)

FOREIGN PATENT DOCUMENTS

EP 1 531 030 A3 8/2005
WO 9916591 4/1999
(Continued)

OTHER PUBLICATIONS

International Search Report for PCT/EP2014/079295 dated Aug. 20, 2015.

*Primary Examiner* — Phong H Nguyen
(74) *Attorney, Agent, or Firm* — Polsinelli PC

(57) ABSTRACT

A shaving blade cartridge including a housing having a top side, a bottom side and two longitudinal sides. A cutting element is mounted in the housing between the longitudinal sides, and is retained in the housing by a retainer. The retainer includes an internal surface which extends in a direction toward the cutting element. The internal surface is provided with a non-smooth pattern that cooperates with the cutting element. The shaving blade cartridge including the retainer having an internal surface provided with a non-smooth pattern is configured to be connected to a handle of a shaver.

17 Claims, 4 Drawing Sheets

(51) Int. Cl.
*B26B 21/52* (2006.01)
*B26B 21/56* (2006.01)

(52) U.S. Cl.
CPC ..... *B26B 21/4068* (2013.01); *B26B 21/521* (2013.01); *B26B 21/565* (2013.01)

(58) Field of Classification Search
USPC ..... 30/50
See application file for complete search history.

(56) References Cited

U.S. PATENT DOCUMENTS

| | | | | |
|---|---|---|---|---|
| 2005/0172489 | A1* | 8/2005 | Aviza | B26B 21/227 30/32 |
| 2005/0172494 | A1* | 8/2005 | Aviza | B26B 21/4068 30/50 |
| 2013/0205595 | A1 | 8/2013 | Bykowski et al. | |
| 2015/0090085 | A1* | 4/2015 | Griffin | B26B 21/4018 83/13 |

FOREIGN PATENT DOCUMENTS

| | | | |
|---|---|---|---|
| WO | 9955499 | | 11/1999 |
| WO | 2007147420 | A1 | 12/2007 |

* cited by examiner

SHAVING BLADE CARTRIDGE AND A SHAVER COMPRISING SUCH SHAVING BLADE CARTRIDGE

CROSS REFERENCE TO RELATED APPLICATION

This application is a National Stage application of International Application No. PCT/EP2014/079295, filed on Dec. 24, 2014, the entire contents of which is incorporated herein by reference.

BACKGROUND

1. Field

The present disclosure relates to shaving blade cartridges and shavers having such shaving blade cartridges. In particular, the present disclosure relates to a shaving blade cartridge including a retainer having an internal surface containing a non-smooth pattern.

2. Description of Related Art

Traditional shaving blade cartridges generally include a retainer for retaining a cutting element in the housing of the shaving blade cartridge. For example, the retainer extends through a pair of holes provided in the housing to retain the cutting elements. According to other examples, the retainer surrounds the housing and is received in a groove provided on the housing. Other traditional shavers include a cartridge having an annular clip with two legs which cooperate with two recesses in the housing. Many of the aforementioned retainers retain the cutting element in the housing in one direction and oftentimes do not allow a retaining of the cutting element in all directions, resulting in a free movement of the cutting element which can reduce control of the blade during shaving. The free movement of the cutting element allows for the blade edge position to change with each shaving stroke which results in the change of the shaving angle.

SUMMARY

According to aspects of the present disclosure, a shaving blade cartridge may include a retainer having an internal surface which may extend in a direction toward the cutting element. The internal surface may be provided with a non-smooth pattern that cooperates with the cutting element. The non-smooth pattern may be an element which may not extend in the continuity of the surfaces directly adjacent to the internal surface. In other words, the non-smooth pattern may form a relief pattern or a relief in the surface of the retainer.

The non-smooth patterns formed on the internal surfaces of the cutting elements may assist with reducing lateral movement of the cutting element and may contribute to controlling improvement the position of the cutting element during a shave.

Aspects of the disclosure may include one or more of the following features:

- the shaving blade cartridge may include a plurality of cutting elements;
- the retainer may include a plurality of non-smooth patterns, and each cutting element may cooperate with one non-smooth pattern; the span between the cutting element (also called inter-blade span) may be better controlled;
- the retainer may extend along a transverse axis, the transverse axis may be perpendicular to the longitudinal axis; the direction of extension of the retainer may allow for a better integration of the clips in the shaving blade cartridge and may allow for a better retention of the cutting element;
- the non-smooth pattern is may be longitudinal;
- the non-smooth pattern may extend along the cutting axis; the non-smooth pattern may cooperate and may be aligned with the cutting element to better maintain the position of the cutting element;
- the retainer may include a width along the cutting axis;
- the non-smooth pattern may extend along the entire width of the retainer; and may extend along the entire surface of the retainer;
- the non-smooth pattern may be longitudinal and may extends along a portion of the width of the retainer; in other words, the non-smooth pattern may not extend along the entire width of the retainer;
- the non-smooth pattern may be a groove; the groove may be easy to manufacture;
- the cutting edge may extend in the groove; the groove may form an easily identifiable position indicator;
- the cutting element may include a tapered shape;
- the shape of the groove may be complementary to the shape of the cutting element and due to the complementary shape of the cutting element and the groove, may allow for precise positioning of the cutting element;
- the retainer may have a thickness, and the groove may extend inside the thickness of the retainer;
- the depth of the groove, in the thickness of the retainer may be less than 50% of the thickness of the retainer; the groove may not be very visible;
- the non-smooth pattern may be a bump protruding from the internal surface of the retainer toward the cutting element; the bump may allow for flexible positioning;
- the bump may include a half-spherical section; the bump may include a sloped shape;
- the bump may be at a non-zero distance of the cutting edge along a transverse axis, the transverse axis may be perpendicular to the longitudinal axis;
- the cutting element may include a bump support and the bump may abut against the bump support;
- the non-smooth pattern may be the combination of a bump protruding from the internal surface of the retainer toward the cutting element and of a groove;
- the retainer may be a clip retaining the cutting element in the housing, the clip may have a clip body located on the top side of the housing, the non-smooth pattern may be provided on the clip body;
- the shaving blade cartridge may include two retainers retaining the cutting elements in the housing, each retainer may include an internal surface which may extend in front of the cutting element, the internal surface may be provided with the non-smooth pattern;
- the non-smooth pattern of the first retainer and the non-smooth pattern of the second retainer may extend along the cutting axis of the cutting element. In other words, the non-smooth pattern of the first retainer and the non-smooth pattern of the second retainer may extend each, as an extension of the other. The non-smooth pattern of the first retainer may align with of the non-smooth pattern of the second retainer.

The present disclosure may also be directed to a shaver including a handle and a shaving blade cartridge as described above, the shaving blade cartridge may be connected to the handle.

BRIEF DESCRIPTION OF THE DRAWINGS

Other characteristics and advantages according to aspects of the present disclosure will readily appear from the following description, provided as non-limitative examples, and shown in the accompanying drawings.

With regards to the figures, the same reference signs designate like or similar elements.

DETAILED DESCRIPTION

Aspects of the disclosure may include a shaving blade cartridge 10 for a wet razor. The wet razor may include a shaver 12 wherein the cutting elements 18 of which may not be driven by a motor relative to the shaving blade cartridge 10.

Figure 8:
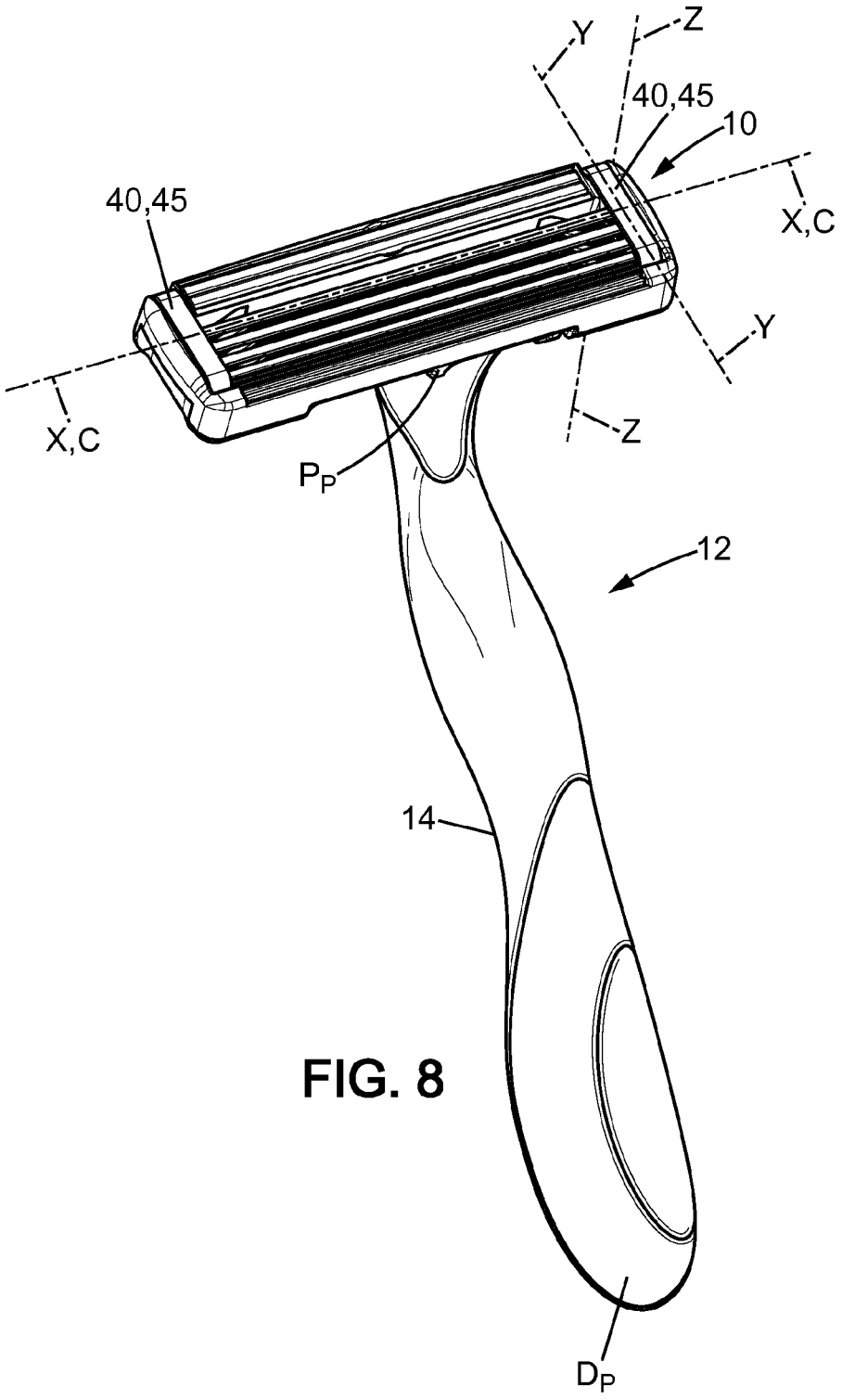
FIG. 8 is a perspective view of a shaver including a handle and a shaving blade cartridge.

As illustrated in FIG. 8, the shaving blade cartridge 10 may be attached to a handle 14. The handle 14 may extend in a handle direction between a proximal portion Pp and a distal portion Dp. The handle 14 may pivot with regard to the shaving blade cartridge 10. According to some aspects, the handle 14 may also be fixed with regard to the shaving blade cartridge 10. The handle 14 direction may be curved or include one or several straight portions. The shaving blade cartridge 10 may be non-detachable from the handle 14 or may be releasably connected to the handle 14 through a lock-and-release mechanism (not illustrated). The shaving blade cartridge 10 may include a housing 16 which may, for example, include a connection mechanism adapted to connect to the handle 14.

Figure 1:
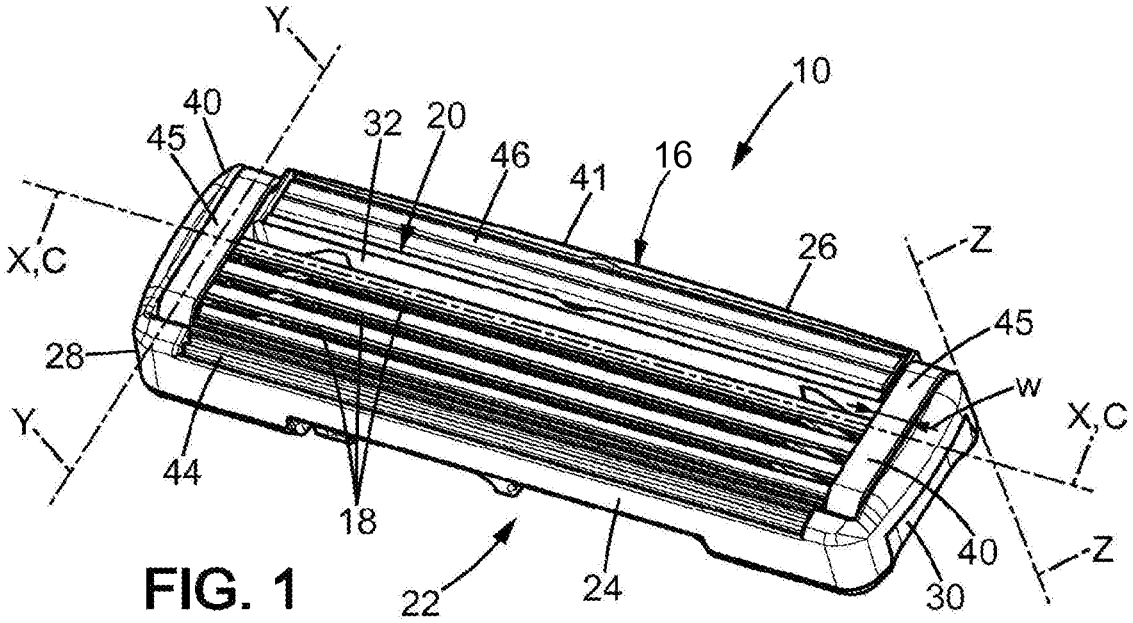
FIG. 1 is a perspective view of a shaving blade cartridge according to an aspect of the disclosure.

As depicted in FIG. 1, the shaving blade cartridge 10 may include a housing 16, a cutting element 18 mounted in the housing 16 and a retainer retaining the cutting element 18 in the housing 16.

The housing 16 may extend longitudinally along a longitudinal axis X-X. Viewed from the top, and as best seen in FIG. 1, the housing 16 may have a rectangular general shape. However, in some aspects, the general shape of the housing 16 may be different; for example, the housing 16 may have an oval shape, a square shape, or a circular shape.

The housing 16 may include a top side 20, a bottom side 22 opposite to the top side 20 and two longitudinal sides 24, 26. The two longitudinal sides 24, 26 may extend longitudinally along the longitudinal axis X-X between the top and bottom sides 20, 22. For example, the bottom side 22 may be adapted to be arranged in front of the handle 14, whereas the top side 20 may be arranged opposite to the bottom side 22. The top side 20 and the bottom side 22 may be parallel to each other.

The first longitudinal side 24 (also called front longitudinal side 24) and the second longitudinal side 26 (also called rear longitudinal side 26) may face each other. The second longitudinal side 26 may be approximately parallel to the first longitudinal side 24, especially when the two longitudinal sides 24, 26 are flat. However, the two longitudinal sides 24, 26 may also have subtle or noticeable opposing inclinations. The first and second longitudinal sides 24, 26 may also have curved surfaces. The first and second longitudinal sides 24, 26 may each extend in a lateral direction Z along a lateral axis Z-Z, between the top side 20 and the bottom side 22 of the housing 16. The lateral axis Z-Z may intersect the longitudinal axis X-X. For example, the longitudinal axis X-X and the lateral axis Z-Z may be orthogonal to each other.

The housing 16 may also include first and second lateral sides 28, 30 which may extend between the first and second longitudinal sides 24, 26 along a transverse axis Y-Y. The transverse axis Y-Y may be perpendicular to the longitudinal axis X-X. The transverse axis Y-Y may be, for example, orthogonal to the longitudinal axis X-X and to the lateral axis Z-Z. The first and second lateral sides 28, 30 may be arranged, in the lateral direction Z, between the top side 20 and the bottom side 22. The first and second lateral and longitudinal sides 28, 30, 24, 26, respectively, may form together the external surface of the housing 16.

The housing 16 may include a plastic material. However, other materials may be used. For example, the housing 16 may include a metallic material. Moreover, the housing 16 may be made with a combination of two or more different materials. For example, a part of the housing 16 may be made in a first material, whereas the other part of the housing 16 may be made with a second material.

The housing 16 may include a blade receiving section 32. The blade receiving section 32 or blade receiving area may have a general rectangular shape when viewed from a top view. The blade receiving section 32 may be arranged on the top side 20 of the housing 16. The blade receiving section 32 may define a recess and may be adapted to receive the cutting element 18. More precisely, the blade receiving section 32 may be adapted to receive at least one cutting element 18. In FIG. 1 and FIG. 8, the shaving blade cartridge 10 may include three cutting elements 18. However, according to other aspects, the shaving blade cartridge 10 may include more or less than three cutting elements 18. For example, the shaving blade cartridge 10 may include five cutting elements 18.

The cutting elements 18 may be mounted in the housing 16 in the blade receiving section 32 between the first and second longitudinal sides 24, 26 of the housing 16 and between the first and second lateral sides of the housing 16. Each cutting element 18 may extend longitudinally along a cutting axis C-C. For example, the cutting C-C axis may coincide with the longitudinal axis X-X. The cutting axis C-C may be parallel to the longitudinal axis or may be angled with the longitudinal axis X-X. Each cutting element 18 may include a first and second end along the cutting axis C-C. The first end of the cutting element 18 may be directed toward the first lateral side of the housing 16, whereas the second end of the cutting element 18 may be directed toward the second lateral side of the housing 16. Each cutting element 18 may include a cutting edge 34. The cutting edge 34 may extend along the cutting axis C-C. The cutting edge 34 of the cutting element 18 may be accessible at the top side 20 of the housing 16 to cut hair during a shave.

Figure 2:
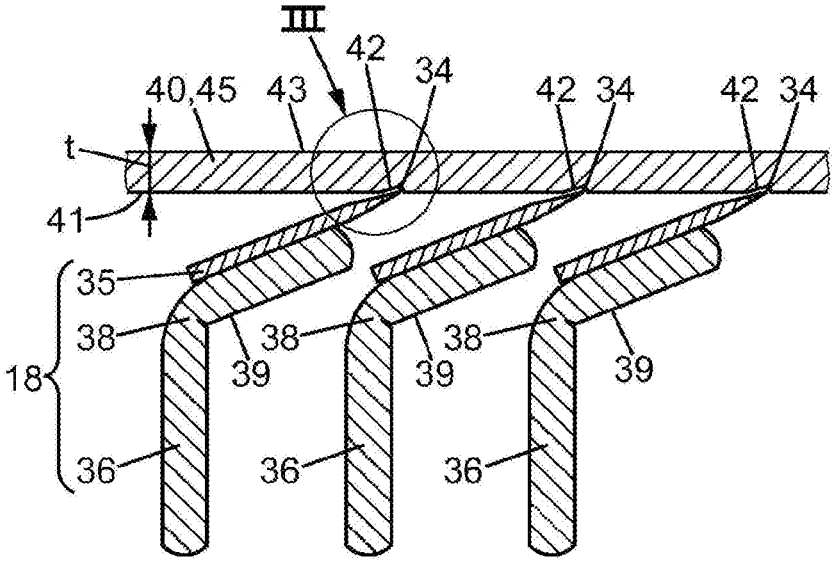
FIG. 2 is a cross sectional view of the cutting elements of the shaving blade cartridge of FIG. 1.
Figure 4:
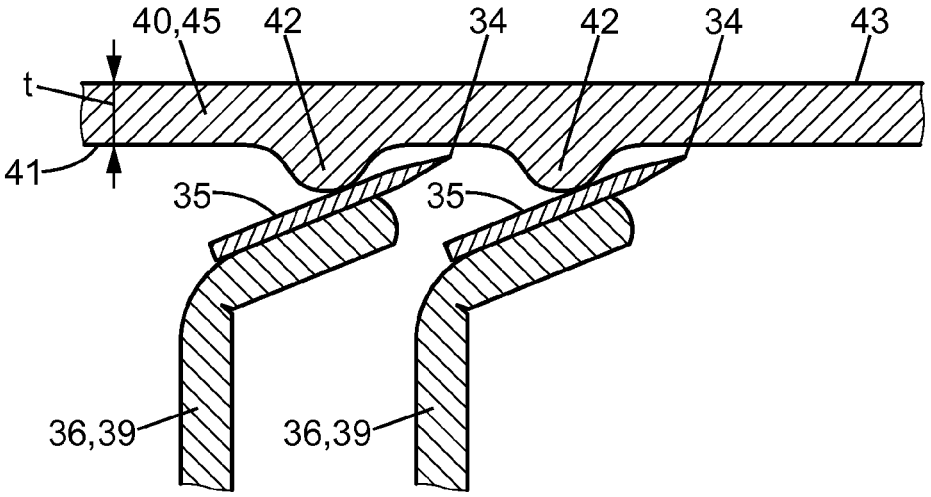
FIG. 4 is a cross sectional view of the cutting elements of the shaving blade cartridge according to a second aspect of the disclosure.

According to some aspects, the cutting elements 18 may be L-shaped cutting elements 18, shown in FIG. 2 and FIG. 4. The cutting elements 18 may have a cutting edge portion 35, a guided portion 36, and a bent portion 38 which may be intermediate to the cutting edge portion 35 and the guided portion 36. The cutting element 18 may be provided with the cutting edge portion (or blade element) 35 fixed on a blade support 39 which may include the guided portion 36 and the bent portion 38.

Each cutting element 18 may be freely mounted in the housing 16. More precisely, the cutting elements 18 may be movably mounted in the blade receiving section 32. Each cutting element 18 may be, for example, supported by two elastic fingers. The elastic fingers may be molded as a single piece with the housing 16 and may extend in the blade receiving section 32 towards each other and upwardly from both lateral sides of the housing 16. The guided portions 36 of the cutting elements 18 may be slidingly guided in slots provided in the housing 16. In case of a blade element 35 on a blade support 39, the blade support 39 may be carried by the elastic fingers.

However, according to other aspects, (not shown on the figures) the cutting elements 18 may be bent blades, as described for instance in patent application WO2013/050606, or curved blades.

The cutting element 18 may be retained in the housing 16 by a retainer 40. The shaving blade cartridge 10 may include two retainers 40 retaining the cutting elements 18 in the housing 16. The two retainers 40 may be identical. However, the two retainers 40 may be different, and for example, they may have different dimensions, different shapes, or different positioning. The following disclosure details one retainer; however, it should be understood that the disclosure applies to one or both retainers 40.

The retainer 40 may include an internal surface 41 which extends in a direction toward the cutting element 18. The retainer 40 may extend along the transversal axis Y-Y.

The retainer 40 may include a portion in front of the cutting element 18, and more particularly, the retainer 40 may include a portion facing the cutting edge 34. The portion of the retainer 40 in front of the cutting edge 34 may form the internal surface 41 of the retainer 40. The internal surface 41 may be provided with a non-smooth pattern 42 that may cooperate with the cutting element 18. The internal surface 41 may be sensibly flat and/or smooth and a relief pattern (or non-smooth pattern 42) may be provided on the internal surface 41 of the retainer 40. The non-smooth pattern 42 may be a groove, a bump, a cavity, a wedge portion, a fulcrum portion or other pattern which may interrupt the linear continuity of adjacent portions of the internal surface 41. In other words, the non-smooth pattern of the retainer 40 may extend outward or inward beyond an adjacent portion of the internal surface 41 of the retainer 40. For example, a discontinuity may be provided on two sides of the non-smooth pattern 42.

The retainer may also include an external surface 43 opposite to the internal surface 41. The external surface 43, or at least a portion of the external surface 43 may be facing the skin of the user during the shaving with the cutting elements 18. The external surface 43 of the retainer may be smooth and/or flat.

The shaving blade cartridge 10 may include a plurality of cutting elements 18 and a plurality of non-smooth pattern 42 may be provided. More particularly, and according to some aspects, a non-smooth pattern 42 may be provided for each cutting element 18. In some aspects, two or more non-smooth patterns 42 may be provided for each cutting element 18.

Figure 6A:
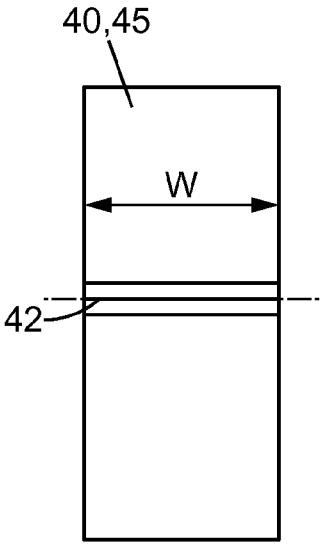
FIG. 6A, FIG. 6B are front and side views of the retainer with the non-smooth pattern extending along the entire width of the retainer.
Figure 6B:
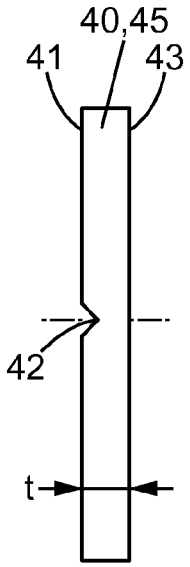

The non-smooth pattern 42 may extend along the cutting axis C-C of the cutting element 18. The retainer 40 may include a width "w" along the cutting axis C-C. According to another aspect, depicted in FIG. 6A and FIG. 6B, the non-smooth pattern 42 may extend along the entire width of the retainer 40.

Figure 7A:
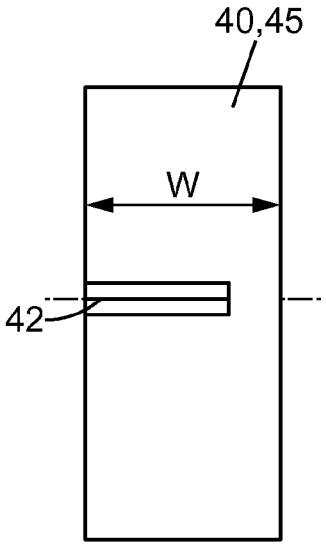
FIG. 7A, FIG. 7B are front and side views of the retainer with the non-smooth pattern extending along a portion of the width of the retainer.
Figure 7B:
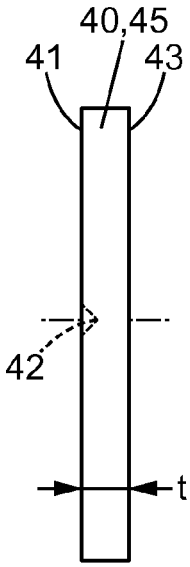

According to further aspects, depicted in FIGS. 7A and 7B, the non-smooth pattern 42 may extend along a portion of the width of the retainer 40. The non-smooth pattern 42 may manage the movement of the cutting elements 18 along the cutting axis C-C.

Figure 3:
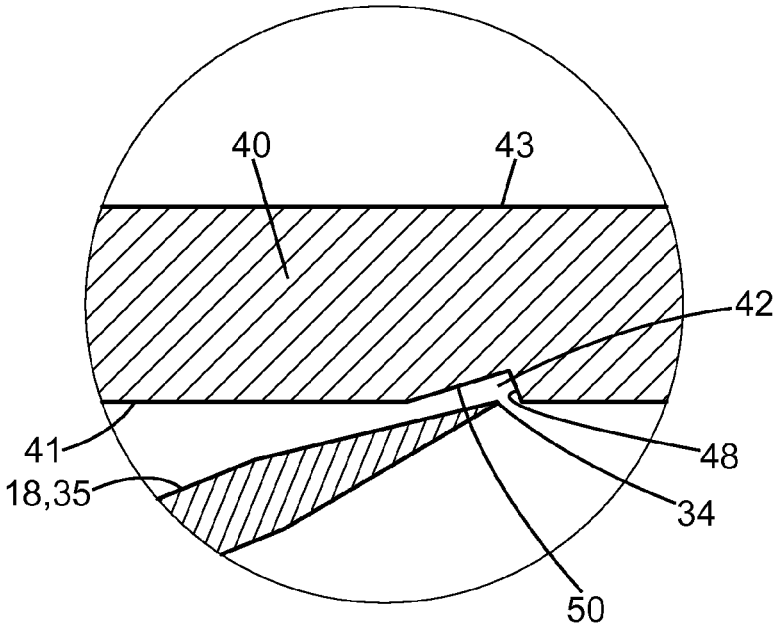
FIG. 3 is a detail of section III in the FIG. 2.

As shown in FIG. 2 and FIG. 3 and according to an aspect, the portion of the retainers 40 in front of the cutting edge 34, or in other words, the interior surface of the retainer 40, which may be located in front of the cutting edge 34, may include a groove 42. The non-smooth pattern 42 may be formed by the groove 42.

Each cutting element 18 may include a groove 42 such that the cutting edge 34 of each cutting element 18 may extend in the groove 42 provided on the interior surface of the retainer 40. The cutting edge 34 may extend in the groove 42. The shape of the groove 42 may be complementary to the shape of the cutting element 18. For example, as shown in FIG. 2 and FIG. 3, the groove 42 may have a V-shape, and the tip of the V may correspond to the tip of the cutting element 18. The cutting element 18 may include a tapered shape toward the cutting edge 34, and the shape of the groove 42 may be complementary to the tapered shape. The groove 42 may have a "control" function and may limit the motion of the cutting elements 18, for example, during shaving, and/or to ensure a constant distance between the cutting edges 34. The groove 42 design may be made to prevent the cutting edge 34 from moving beyond a rest position (i.e. when the cutting element 18 is not subject at any external forces). The groove 42 may have, for example, a first wall 48 (or perpendicular wall) which may be perpendicular to the internal surface 41 of the retainer 40, and a second wall 50 (or ramp wall) which may have a ramp shape. The perpendicular wall 48 may prevent the cutting edge 34 from moving beyond the rest position, in a direction opposite to the direction of the bottom side 22. The ramp wall 50 of the groove 42 may allow the cutting element 18 to move toward the bottom side 22 of the housing 16 and return back to the rest position upon returning from movement during shaving. The groove 42 may not go completely through the entire width 'w' of the retainer 40, such as depicted in FIGS. 7A and 7B, wherein the tip of the cutting element 18 may abut against the groove 42 which controls the movement along the cutting axis C-C.

During a shave (or shortly before), the skin of the user may exert a force on the cutting elements 18 which may therefore be pushed toward the bottom side 22 of the housing 16. Hence, during shaving, the cutting element 18 may not be in contact with the retainer 40. The ramp wall 50 of the groove 42 may accompany the motion of the cutting element 18 toward the bottom side 22. After shaving, when a force may not be_applied to the cutting element 18 and upon the last return of the cutting element 18 to the rest position, the cutting element 18 may be in contact with the retainer 40 and the cutting edge 34 may extend in the groove 42.

The retainer 40 may have a thickness "t" along the lateral axis Z-Z and the groove 42 may extend inside the thickness of the retainer 40. For example, the depth of the groove 42 may be less than 50% of the thickness of the retainer 40. The thickness of the groove 42 may be less than 35% of the thickness of the retainer 40.

According to another aspect, as shown in FIG. 4, the interior surface of the retainer 40 may be provided with a bump. The non-smooth pattern 42 may be a bump. The bump may protrude from the interior surface of the retainer 40, and more particularly from the retainer body. The bump may be a half-sphere shape or may be a beam or a rib along the width "w" of the retainer 40. The bump may be integrally formed with the retainer 40. According to some aspects, the bump may be an added portion. For example, the bump may be welded, glued or fitted to the retainer 40.

As shown in FIG. 4, each cutting element 18 may correspond with a respective bump. The bump may be offset from the cutting edge 34, such that the bump may be arranged between the cutting edge 34 and the guided portion 36 of the cutting element 18. In other words, the bump may be positioned at a non-zero distance of the cutting edge 34 along the transverse axis Y-Y. The bump may abut against a part of the cutting element 18 or against a bump support provided on the cutting element 18, such that the bump may limit a rotational motion of the cutting element 18 during shaving.

Figure 5:
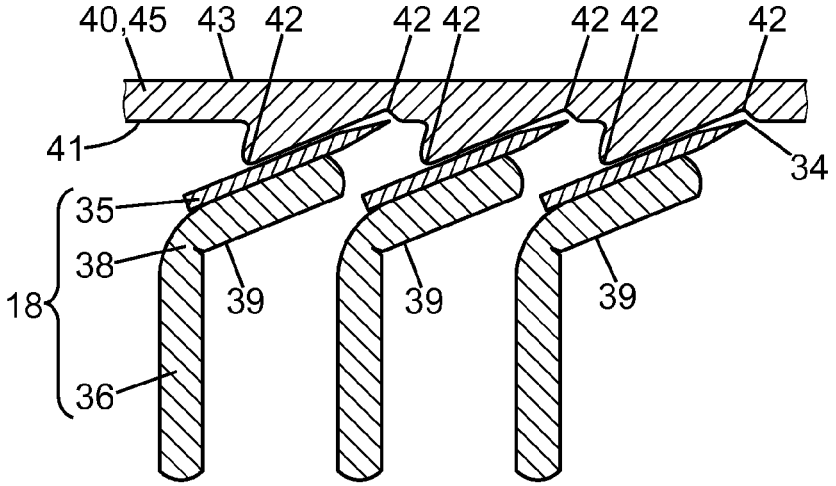
FIG. 5 is a cross sectional view of the cutting elements of the shaving blade cartridge according to a third aspect of the disclosure.

According to further aspects, as shown in FIG. 5, the interior surface of the retainer 40 may be provided with both a bump and a groove. The non-smooth pattern 42 may thus be formed by the combination of the bump and of the groove. The groove may be arranged in the continuity of the bump, such that the bump and the groove form a sloped surface. The internal surface 41 of the cutting element 18 may abut against the bump whereas the cutting edge 34 of the cutting element 18 may cooperate with the groove.

The shaving blade cartridge 10 may be provided with two retainers 40. The non-smooth pattern 42 of the first retainer 40 and the non-smooth pattern 42 of the second retainer 40 may be the same or may be different. For example, the first clip may have a non-smooth pattern 42 whereas the second clip may not have a non-smooth pattern 42.

The non-smooth pattern 42 of the first retainer 40 and the non-smooth pattern 42 of the second retainer 40 may extend along the cutting axis C-C, one as an extension of the other. In other words, the direction of extension of a non-smooth pattern 42 of the first retainer 40 and the direction of extension of a non-smooth pattern 42 of the second retainer 40 may be the same. If the non-smooth pattern 42 are grooves, the grooves of the second retainer 40 may extend along the same direction as the grooves of the first retainer 40.

According to further aspects, as shown in FIGS. 1 and 8, the retainer 40 may be a clip. The shaving blade cartridge 10 may include two retainers, i.e. two clips.

The distance between the two clips may be smaller than the length of the cutting element 18, such that the first and the second clip may each have a portion which may be in front of the cutting elements 18. The portions of the clips in front of the cutting element 18 may retain the cutting element 18 and may include the non-smooth pattern 42. The portion of clips in front of the cutting element 18 may abut against the cutting element 18 when the cutting elements 18 may be in a rest-position (i.e. when no external force is applied to the shaving blade cartridge 10).

In addition, the retainer 40 (or clip) may include an aluminum alloy material and the cutting element 18 may include a steel alloy material.

Clips, as shown in FIG. 1 and FIG. 8 include a first leg, a second leg and a clip body 45. The clip body 45 may extend between the first and second legs. The clip body 45, first leg and second leg may form a one-piece part. The clip may be made of a formable material, for example, a thin sheet of suitable metal. However, other materials may be considered. The width of the clip may be constant along the length of the clip. The clip may be made of metal material, for example, thin metal. According to some aspects, a leg of the clip may surround the first longitudinal side 24 of the housing 16, and at least a portion of the bottom side 22 of the housing 16. In other words, a portion of the clip may be wrapped around a portion of the housing 16. A leg of the clip may also be received in a through hole provided in the housing 16.

According to further aspects, the retainer 40 may have other shapes. For example, the retainer 40 may be fixed to the housing 16 by snap-fitting, press-fitting or may also be welded to the housing 16. The retainer 40 may also be a clip with a leg including a recess and the recess may cooperate with a protrusion provided in the housing 16. The retainer 40 may be provided with a body facing the cutting element 18 and without a leg. The retainer 40 may also be retained on the housing 16 by a rivet.

The shaving blade cartridge 10 may include a guard 44. The guard 44 may be located forward of the cutting element 18. More particularly, the guard 44 may be located forward of the cutting edge 34. The guard 44 may be located toward the first longitudinal side 24 (the first longitudinal side 24 may also be called rear longitudinal side). The guard 44 may extend along the longitudinal axis X-X.

The shaving blade cartridge 10 may include a cap 46. The cap 46 may be located rearward of the cutting edge 34. The cap 46 may be located toward the first longitudinal side 28. For example, the cap 46 may be provided on a rear element. The rear element may have a T-shape or U-shape with a leg of the rear element fitted inside the housing 16. The leg may be press-fitted or snap-fitted inside the housing 16. However, according to other aspects, the rear element may be fastened to the housing 16 by others methods or means like glue or overmoulding.

The invention claimed is:

1. A shaving blade cartridge comprising:

a housing extending longitudinally along a longitudinal axis, having a top side, a bottom side opposite to the top side and two longitudinal sides extending longitudinally along the longitudinal axis between the top and bottom sides, a cutting element disposed in the housing between the longitudinal sides, and having a cutting edge extending along a cutting axis, the cutting elements being configured to be movably mounted within the housing, a retainer retaining the cutting element in the housing, wherein the retainer includes an internal surface which extends in a direction toward the cutting element, the internal surface being provided with a non-smooth pattern that cooperates with the cutting element, the non-smooth pattern including a groove, the groove includes a ramp wall, the ramp wall extends at an angle relative to the internal surface, and directly intersects with a wall that extends perpendicular to the internal surface.

2. The shaving blade cartridge according to claim 1, wherein the cutting element includes a plurality of cutting elements and the retainer is provided with a plurality of non-smooth pattern, and each cutting element cooperates with a respective non-smooth pattern.

3. The shaving blade cartridge according to claim 1, wherein the retainer extends along a transverse axis, the transverse axis being perpendicular to the longitudinal axis, and wherein the non-smooth pattern extends along the cutting axis.

4. The shaving blade cartridge according to claim 3, wherein the retainer includes a width along the cutting axis, and the non-smooth pattern is longitudinal and extends along the entire width of the retainer.

5. The shaving blade cartridge according to claim 1, wherein the retainer includes a width along the cutting axis, and the non-smooth pattern is longitudinal and extends along a portion of the width of the retainer.

6. The shaving blade cartridge according to claim 1, wherein the non-smooth pattern is a groove, and wherein the cutting edge extends in the groove.

7. The shaving blade cartridge according to claim 6, wherein the cutting element includes a tapered shape, and the shape of the groove is complementary to the shape of the cutting element.

8. The shaving blade cartridge according to claim 1, wherein the retainer is a clip retaining the cutting element in the housing, the retainer body being a clip body located on the top side of the housing, and the non-smooth pattern being provided on the clip body.

9. The shaving blade cartridge according to claim 1, wherein the shaving blade cartridge includes two retainers retaining the cutting element in the housing, each retainer including an internal surface which extends in front of the cutting element, and the internal surface being provided with the non-smooth pattern.

10. The shaving blade cartridge according to claim 9, wherein the non-smooth pattern of the first retainer and the non-smooth pattern of the second retainer extend along the cutting axis of the cutting element.

11. A shaving blade cartridge comprising:

a housing extending longitudinally along a longitudinal axis, having a top side, a bottom side opposite to the top side and two longitudinal sides extending longitudinally along the longitudinal axis between the top and bottom sides, a cutting element mounted in the housing between the longitudinal sides, and having a cutting edge extending along a cutting axis, a retainer retaining the cutting element in the housing, wherein the retainer includes a body having an internal surface which extends in a direction toward the cutting element, the internal surface being provided with a non-smooth pattern that cooperates with the cutting element, wherein the non-smooth pattern includes a bump protruding from the internal surface, wherein the bump includes non-planar surfaces and is positioned to contact a top surface of the cutting element that is adjacent to the internal surface, the contact being such that the non-planar surfaces of the bump limit a rotational motion of the cutting element during shaving.

12. The shaving blade cartridge according to claim 11, wherein the cutting element includes a guided portion, wherein the bump is arranged between the cutting edge and the guided portion of the cutting element.

13. The shaving blade cartridge according to claim 11, wherein the non-smooth pattern further includes a groove, the bump including a sloped surface which flows into the groove such that a combination of the bump and the groove forms a continuous surface.

14. The shaving blade cartridge according to claim 11, wherein the bump includes a curved surface.

15. The shaving blade cartridge according to claim 11, wherein the bump includes a half-spherical section.

16. The shaving blade cartridge according to 33, wherein the bump is at a non-zero distance of the cutting edge along a transverse axis, the transverse axis being transverse to the longitudinal axis (X-X).

17. The shaving blade cartridge according to claim 11, wherein the cutting element includes a bump support and the bump abuts against the bump support.

* * * * *